US011565140B2

(12) United States Patent
Tampoya

(10) Patent No.: US 11,565,140 B2
(45) Date of Patent: Jan. 31, 2023

(54) TRAINING APPARATUS FOR USE IN WATER

(71) Applicant: Monsoon Sports, LLC, Omaha, NE (US)

(72) Inventor: Christopher Alan Tampoya, Moorpark, CA (US)

(73) Assignee: Monsoon Sports, LLC, Omaha, NE (US)

( * ) Notice: Subject to any disclaimer, the term of this patent is extended or adjusted under 35 U.S.C. 154(b) by 383 days.

(21) Appl. No.: 16/687,295

(22) Filed: Nov. 18, 2019

(65) Prior Publication Data

US 2020/0155886 A1 May 21, 2020

Related U.S. Application Data

(60) Provisional application No. 62/768,720, filed on Nov. 16, 2018.

(51) Int. Cl.

| | |
|---|---|
| ***A63B 59/50*** | (2015.01) |
| ***A63B 21/008*** | (2006.01) |
| ***A63B 69/00*** | (2006.01) |
| ***A63B 69/36*** | (2006.01) |

(52) U.S. Cl.

CPC ..... *A63B 21/0084* (2013.01); *A63B 69/0002* (2013.01); *A63B 69/3623* (2013.01); *A63B 2069/0008* (2013.01)

(58) Field of Classification Search

CPC ..... A63B 21/0084; A63B 69/3623; A63B 69/3632; A63B 69/3638; A63B 2069/0008

See application file for complete search history.

(56) References Cited

U.S. PATENT DOCUMENTS

| | | | | | |
|---|---|---|---|---|---|
| 1,025,478 | A * | 5/1912 | Murphy | A63B 59/52 | 473/568 |
| 3,809,397 | A * | 5/1974 | Gruenewald | A63B 69/0002 | 473/228 |
| 5,179,255 | A * | 1/1993 | Yeh | A63B 59/59 | 181/182 |
| 6,048,283 | A * | 4/2000 | Albarelli, Jr. | A63B 60/06 | 473/612 |

(Continued)

FOREIGN PATENT DOCUMENTS

GB 190724549 A 11/1908

OTHER PUBLICATIONS

International Search Report and Written Opinion dated Feb. 6, 2020 for PCT/US2019/062036.

(Continued)

*Primary Examiner* — Joshua T Kennedy
(74) *Attorney, Agent, or Firm* — Suiter Swantz pc llo

(57) ABSTRACT

An underwater training apparatus is disclosed. The underwater training apparatus may include a barrel. The barrel may contain a plurality of holes disposed across the barrel. Each of the holes of the barrel may pass through a wall of the barrel. The underwater training apparatus may also include a base funnel. The base funnel may contain a plurality of holes disposed across the base funnel. Each of the holes of the base funnel may pass through a wall of the base funnel. The underwater training apparatus may also include a handle. The handle may mechanically couple the barrel and the base funnel.

18 Claims, 7 Drawing Sheets

(56) References Cited

U.S. PATENT DOCUMENTS

| | | | | |
|---|---|---|---|---|
| 6,325,727 | B1 * | 12/2001 | Carr | A63B 21/0084 482/111 |
| 7,207,907 | B2 | 4/2007 | Guenther et al. | |
| 7,717,812 | B2 | 5/2010 | Winger | |
| 8,096,902 | B2 | 1/2012 | Winger | |
| 8,409,037 | B2 * | 4/2013 | Imatoh | A63B 21/0088 473/422 |
| 2004/0116256 | A1 * | 6/2004 | Stout | A63B 21/4043 482/55 |
| 2009/0227400 | A1 * | 9/2009 | Winger | A63B 69/0002 473/451 |
| 2011/0172035 | A1 * | 7/2011 | Gregory | A63B 59/52 473/457 |
| 2016/0001148 | A1 * | 1/2016 | Mitton | A63B 60/16 473/564 |
| 2016/0279492 | A1 * | 9/2016 | Blinzler | A63B 60/54 |

OTHER PUBLICATIONS

Easton T10 Thunderstick, Mar. 28, 2016, retrieved on Jan. 17, 2020, <https://www.amazon.com/Easton-T10-Thunderstick-33-Inch-37-Ounce/dp/B00110U0MO/ref=pd_bxgy_3/130-0624189-0695429?_encoding=UTF8&pd_rd_i=B00110U0MO&pd_rd_r=b76b34c7-BeB0-4416-afd0-a525fd8583b3&>.
https://watertrainingdevices.com (2010); https://www.youtube.com/watch?v=grR1ypR49qk&t=3s.

* cited by examiner

TRAINING APPARATUS FOR USE IN WATER

CROSS-REFERENCE TO RELATED APPLICATION

The present application claims the benefit under 35 U.S.C. § 119(e) of U.S. Provisional Application Ser. No. 62/768,720, filed Nov. 16, 2018, entitled, TRAINING APPARATUS FOR USE IN WATER, naming Christopher Alan Tampoya as inventor, which is incorporated herein by reference in the entirety.

TECHNICAL FIELD

The present invention generally relates to physical training, more particularly, to an underwater training apparatus.

BACKGROUND

In many sports the individual with the greatest strength will have an advantage. Current devices and methods that improve strength expose an individual to an increased chance of injury. It is desirable to provide devices and methods that improve strength while limiting the risk of injury. For example, it is advantageous to strengthen the muscles utilized to swing a baseball or softball bat, golf club, tennis racket, or hockey stick. A repetitive motion of swinging a bat through the air lacks significant resistance and increases the risk of injury to an individual. As such, it would be desirable to provide an apparatus that addresses the shortcomings of the previous approaches provided above.

SUMMARY

An underwater training apparatus is disclosed, in accordance with one or more embodiments of the present disclosure. In one illustrative embodiment, the underwater training apparatus includes a barrel. The barrel may contain a plurality of holes disposed across the barrel. Each of the holes of the barrel may pass through a wall of the barrel. In another illustrate embodiment, the underwater training apparatus includes a base funnel. The base funnel may contain a plurality of holes disposed across the base funnel. Each of the holes of the base funnel may pass through a wall of the base funnel. In another illustrative embodiment, the underwater training apparatus includes a handle. The handle may mechanically couple the barrel and the base funnel.

An underwater training apparatus is disclosed, in accordance with one or more embodiments of the present disclosure. In one illustrative embodiment, the underwater training apparatus includes a barrel. The barrel may contain a plurality of holes disposed across the barrel. Each of the holes of the barrel may pass through a wall of the barrel. The barrel may be shaped as a barrel of at least one of a baseball bat or a softball bat. In another illustrate embodiment, the underwater training apparatus includes a base funnel. The base funnel may contain a plurality of holes disposed across the base funnel. Each of the holes of the base funnel may pass through a wall of the base funnel. The base funnel may have a diameter between 3.5 and 4.5 inches. In another illustrative embodiment, the underwater training apparatus includes a handle. The handle may mechanically and fluidically couple the barrel and the base funnel.

An underwater training apparatus is disclosed, in accordance with one or more embodiments of the present disclosure. In one illustrative embodiment, the underwater training apparatus includes a head. The head may include a plurality of holes disposed across the head. Each of the holes may pass through a wall of the head. In another illustrative embodiment, the underwater training apparatus includes a shaft. The shaft may include a plurality of holes disposed across the shaft. Each of the holes may pass through a wall of the shaft. The shaft may mechanically and fluidically couple to the head. In another illustrative embodiment, the underwater training apparatus includes a handle. The handle may mechanically and fluidically couple to the shaft. In another illustrative embodiment, the underwater training apparatus includes a knob. The knob may be disposed at an end of the handle and include a channel for allowing fluid flow through the knob. The knob may mechanically and fluidically couple to the handle. The head, the shaft, the handle, and the knob may be fluidically coupled such that water can flow through the head, the shaft, the handle, and the knob.

It is to be understood that both the foregoing general description and the following detailed description are exemplary and explanatory only and are not necessarily restrictive of the invention as claimed. The accompanying drawings, which are incorporated in and constitute a part of the specification, illustrate embodiments of the invention and together with the general description, serve to explain the principles of the invention.

BRIEF DESCRIPTION OF THE DRAWINGS

The numerous advantages of the disclosure may be better understood by those skilled in the art by reference to the accompanying figures in which.

DETAILED DESCRIPTION OF THE INVENTION

It is to be understood that both the foregoing general description and the following detailed description are exemplary and explanatory only and are not necessarily restrictive of the invention as claimed. Also, it is to be understood that the phraseology and terminology used herein is for the purpose of description and should not be regarded as limiting. The accompanying drawings, which are incorporated in and constitute a part of the specification, illustrate embodiments of the invention and, together with the general description, serve to explain the principles of the invention.

Reference will now be made in detail to the subject matter disclosed, which is illustrated in the accompanying drawings.

FIGS. 1-5 generally illustrate a training apparatus 100 for underwater training, in accordance with one or more embodiments of the present disclosure.

The training apparatus 100 of the present disclosure may be used for training in underwater settings. For example, an individual may swing the training apparatus 100 through water. It is noted herein that the use of the apparatus 100 of the present disclosure may assist in building muscle strength, swing speed, quickness, and power due to the increased resistance of the water medium on the training apparatus 100 relative to air.

Figure 1:
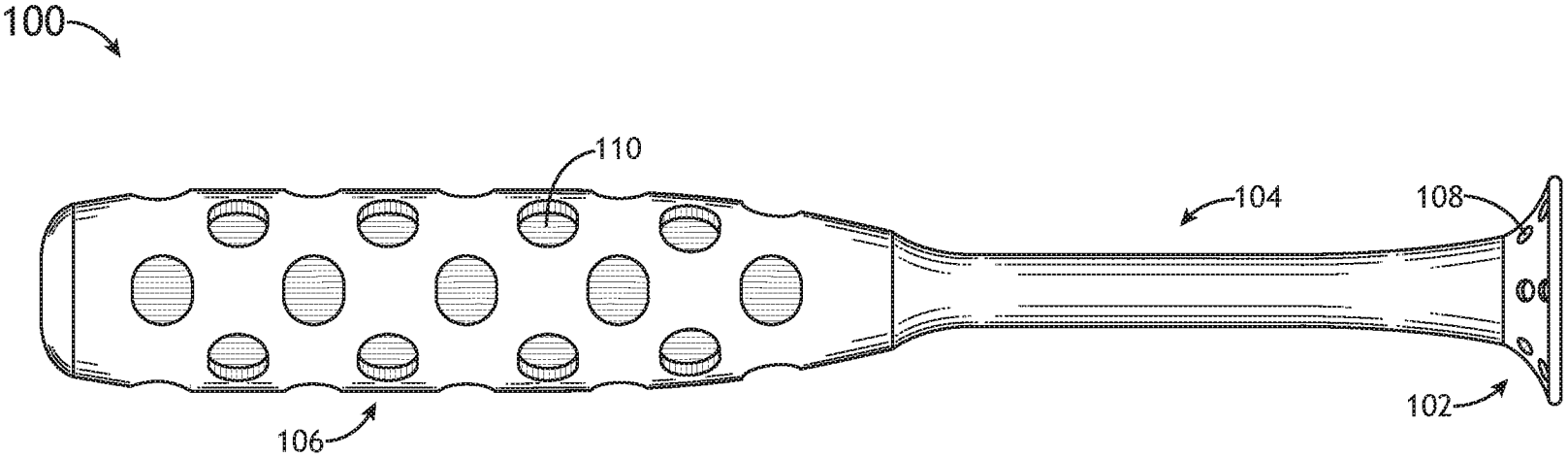
FIG. 1 illustrates a side view of a training apparatus, in accordance with one or more embodiments of the present disclosure.

FIG. 1 illustrates a side view of the training apparatus 100, in accordance with one or more embodiments of the present disclosure. In one embodiment, the training apparatus 100 includes a base funnel 102. In another embodiment, the training apparatus 100 includes a handle 104. In another embodiment, the training apparatus 100 includes a barrel 106. In another embodiment, the base funnel 102 includes a plurality of holes 108 disposed across the funnel 102, whereby each hole passes through the wall of the funnel 102. In another embodiment, the barrel 106 includes a plurality of holes 110 disposed across the barrel 106, whereby each hole passes through the wall of the barrel 106.

In another embodiment, a plurality of holes (not shown) are disposed in the handle 104 of the apparatus 100. For example, the plurality of holes may be located at the upper and/or lower portions of the handle 104. For instance, plurality of holes may be located at the upper and/or lower portions of the handle 104 where the handle 104 joins the base funnel 102 and the barrel 106 respectively.

It is noted herein that the plurality of holes 108, 110 disposed in the apparatus 100 provide a steady and even flow of resistance as the training apparatus 100 is swung through water and/or air. It is also noted herein that the enlarged base funnel 102 of the apparatus 100 creates an increased initial resistance to motion through water prior to the barrel 106 of the apparatus 100 being brought around in a swinging motion relative to a traditional bat end shape. For example, during a typical baseball bat swing, a motion will involve an individual first moving the knob of the bat forward, just prior to swinging the barrel of the bat around to hit a ball. During use of the training apparatus, the base funnel 102 of the training apparatus 100 provides resistance to this initial motion, which cannot be replicated using the resistance of the barrel by itself (as the long-side of the barrel is not moving significantly against the water in the early segments of the swing motion). This resistance contributes to improved swing quickness at the beginning of an individual's swing.

The holes 108 of the funnel 102 and/or the holes 110 of the barrel 106 may be of any selected size. In one embodiment, the barrel 106 contains holes 110 that are the same size. In another embodiment, the barrel 106 contains the holes 110 of two or more different sizes that are at least two different sizes. In one embodiment, the base funnel 102 contains holes 108 that are the same size. In another embodiment, the barrel funnel 102 contains the holes 108 that are at least two different sizes. It is noted herein that the size of the plurality of holes 108, 110 shown in FIG. 1 is provided merely for illustrative purposes.

The holes 108/110 may be arranged in any pattern with any selected spacing. For example, the holes 108 of the funnel 102 and/or the holes 110 of the barrel 106 may be evenly spaced. For example, the barrel 106 may contain holes 110 located in evenly spaced rows and/or columns. For instance, there may be 3-7 rows of holes 110 along the barrel 106 (left to right in FIG. 1). In another instance, there may be 5-10 columns of holes 110 around the barrel 106 (see FIGS. 1-3).

By way of another example, the funnel 102 may contain holes 108 located in evenly spaced rows and/or columns. For instance, there may be 1-4 rows of holes 108 along the funnel 102. In another instance, there may be 5-10 columns of holes 108 around the funnel (see FIG. 3). It is further noted that the holes and spacings of the holes 108, 110 need not be regular or evenly spaced. The plurality of holes 108 of the funnel 102 may be arranged in a circle around the base funnel 102. For example, the base funnel 102 may contain 1-3 sets of holes arranged in separate circles around the base funnel 102. For instance, the base funnel 102 may contain two sets of holes arranged in two circles around the base funnel 102. In another embodiment, the base funnel 102 includes one or more sets of 6-8 holes arranged in a circle around the base funnel 102. For example, the base funnel 102 may contain two sets of 7 holes arranged in two circles around the base funnel 102.

It is noted herein that the shape of the plurality of holes 108, 110 may be any shape (or curved shaped to conform with the curvature of the apparatus 100) known in the art. The circular shape shown in FIG. 1 is provided merely for illustrative purposes. The shape of the holes may include, but is not limited to, curved circles, ellipses, ovals, quadrilaterals, polygons, and the like. Moreover, the shape of the holes 108, 110 may have shapes that significantly depart from the shapes shown in FIGS. 1-5. For example, the holes 108 and/or the holes 110 may include a set of parallel vents (i.e., long rectangular, ellipse, and/or oval shaped openings) running the length of the funnel 102 and/or barrel 106 or encircling the funnel 102 and/or barrel 106.

The plurality of holes 108 may pass through the surface of the funnel 102 such that when in operation the water and/or air can flow through the holes 108. The plurality of holes 110 may pass through the surface of the barrel 106 such that when in operation the water and/or air can flow through the holes 110 and enter the interior of the barrel 106.

In one embodiment, the base funnel 102 connects to the handle 104 such that the handle 104 is mechanically and fluidically coupled to the base funnel 102 such that water and/or air can flow through the handle 104 and the base funnel 102. For example, the training apparatus 100 tapers from the base funnel 102 to join with the handle 104. In another embodiment, a portion of the handle 104 has a diameter smaller than the diameter of the base funnel 102. In another embodiment, the handle 104 joins with the barrel 106 such that the handle 104 and barrel 106 are fluidically coupled to allow water and/or air to flow through the handle 104 and barrel 106. For example, the diameter of the handle 104 may widen to join with the barrel 106 of the training apparatus 100. In another embodiment, the handle 104 is (or is approximately) the same diameter between the base funnel 102 and the barrel 106. In another embodiment, the handle 104 tapers between the base funnel 102 and the barrel 106.

In one embodiment, the handle 104 is sufficiently long to allow a person to grasp the handle 104 of the training apparatus 100 with one or more hands. For example, the handle 104 may be sufficiently long to allow a person to grasp the handle 104 of the training apparatus 100 with each hand located next to the other. It is noted herein that specific length shown in FIG. 1 is provided merely for illustrative purposes and should not be interpreted as limiting the scope or spirit of the present disclosure.

In one embodiment, the handle 104 is smooth. In another embodiment, the handle 104 is textured. For example, the handle 104 may have a roughened surface. By way of another example, the handle 104 may have a patterned surface. For instance, the handle 104 may have lines or grooves oriented lengthwise, widthwise, or at a diagonal along at least a portion of the handle 104. It is noted herein that features located on the handle 104 of the apparatus are thought to aid an individual in grasping the apparatus in a steady manner and prevent the apparatus from slipping when being swung.

Figure 2:
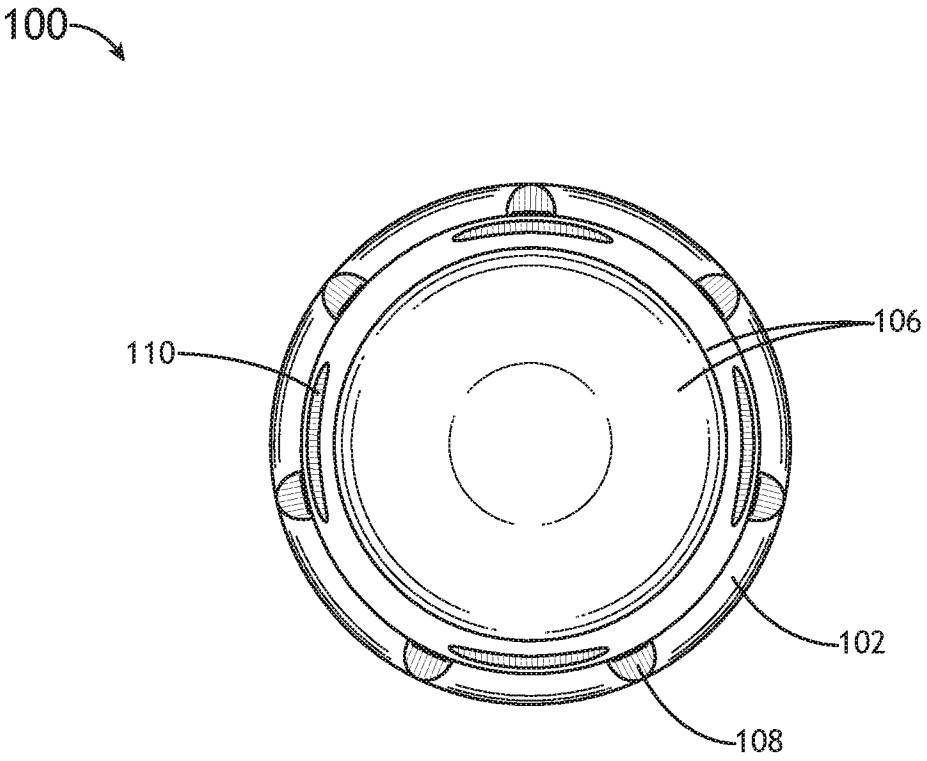
FIG. 2 illustrates a top view of the training apparatus, in accordance with one or more embodiments of the present disclosure.

FIG. 2 illustrates a top view of the training apparatus 100, in accordance with one or more embodiments of the present disclosure. In one embodiment, the diameter of the base funnel 102 is larger than the diameter of the barrel 106. In another embodiment, the diameter of the training apparatus 100 is symmetric about an axis centered along the length of the training apparatus 100.

Figure 3:
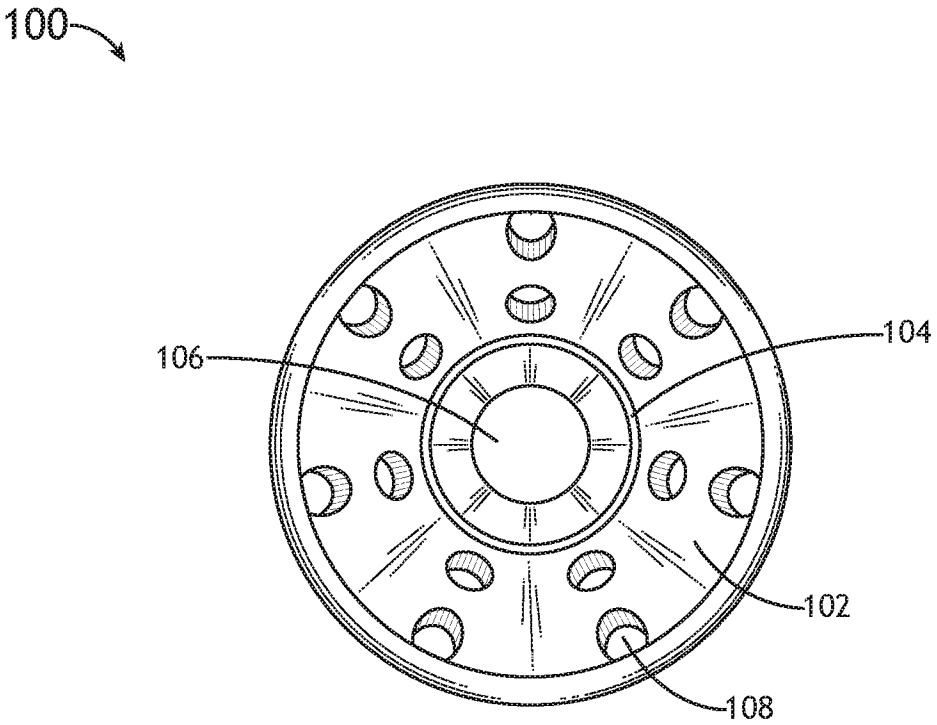
FIG. 3 illustrates a bottom view of the training apparatus, in accordance with one or more embodiments of the present disclosure.

FIG. 3 illustrates a bottom view of the training apparatus 100, in accordance with one or more embodiments of the present disclosure. In one embodiment, the diameter of the handle 104 is smaller than the diameter of the base funnel 102. In another embodiment, the diameter of the handle 104 is smaller than the diameter of the barrel 106.

It is noted herein that the width of the base funnel 102 is intended to be sufficiently small to not interfere with an individual swinging the training apparatus 100 or make swinging the training apparatus 100 uncomfortable, but large enough to increase fluid resistance against the bat as compared to a traditional bat end. In one embodiment, the base funnel 102 has a diameter of 2.5-6 inches at the base of the funnel. For example, the base funnel 102 may have a diameter of 2.5-4.5 inches at the base of the funnel. For instance, the base funnel 102 may have a diameter of 3.5 inches at the base of the funnel. As noted previously herein, the base funnel 102 helps train and assist an individual to gain quickness and strength on the initial approach to a baseball.

Figure 4:
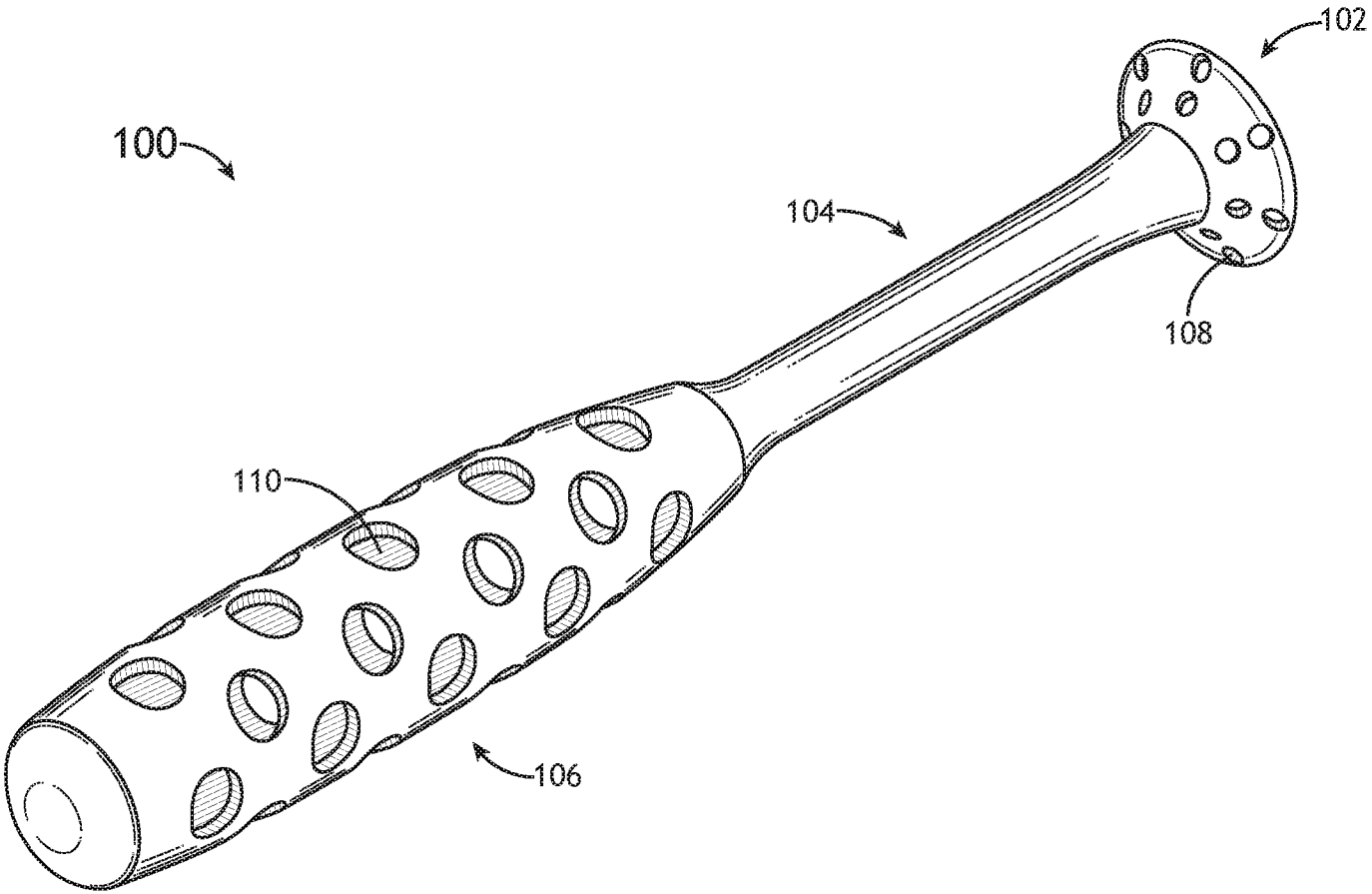
FIG. 4 illustrates an isometric view of the training apparatus, in accordance with one or more embodiments of the present disclosure.

FIG. 4 illustrates an isometric view of the training apparatus 100, in accordance with one or more embodiments of the present disclosure. In one embodiment, the end of the barrel 106 is flat. In another embodiment, the end of the barrel 106 is curved or rounded. In another embodiment, the base funnel 102 has a thicker end edge contour than the thickness of the rest of the base funnel 102.

By way of example, during operation an individual at least partially submerged in water may swing the training apparatus 100 such that at least a portion of the apparatus 100 passes through the water during the swing. For example, an individual submerged in water up to the chest may swing the training apparatus 100. It is noted that the individual may be partially or entirely submerged in water.

Figure 5:
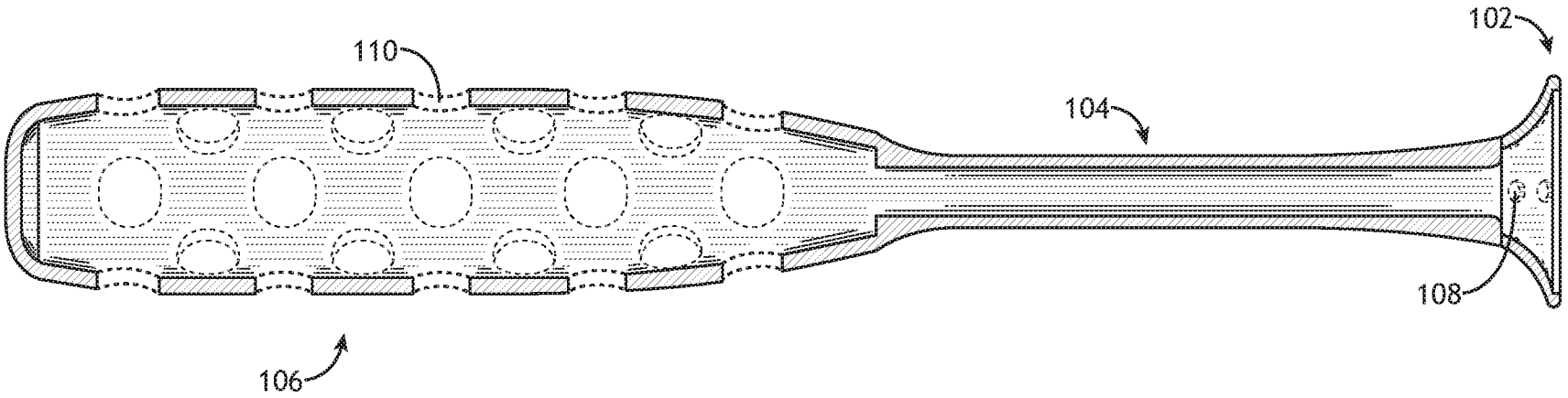
FIG. 5 illustrates a cross-section view of the training apparatus, in accordance with one or more embodiments of the present disclosure.

FIG. 5 illustrates a cross section view of the training apparatus 100, in accordance with one or more embodiments of the present disclosure. In one embodiment, the training apparatus 100 is hollow such that the base funnel 102, the handle 104, and the barrel 106 are mechanically coupled.

Figure 6A:
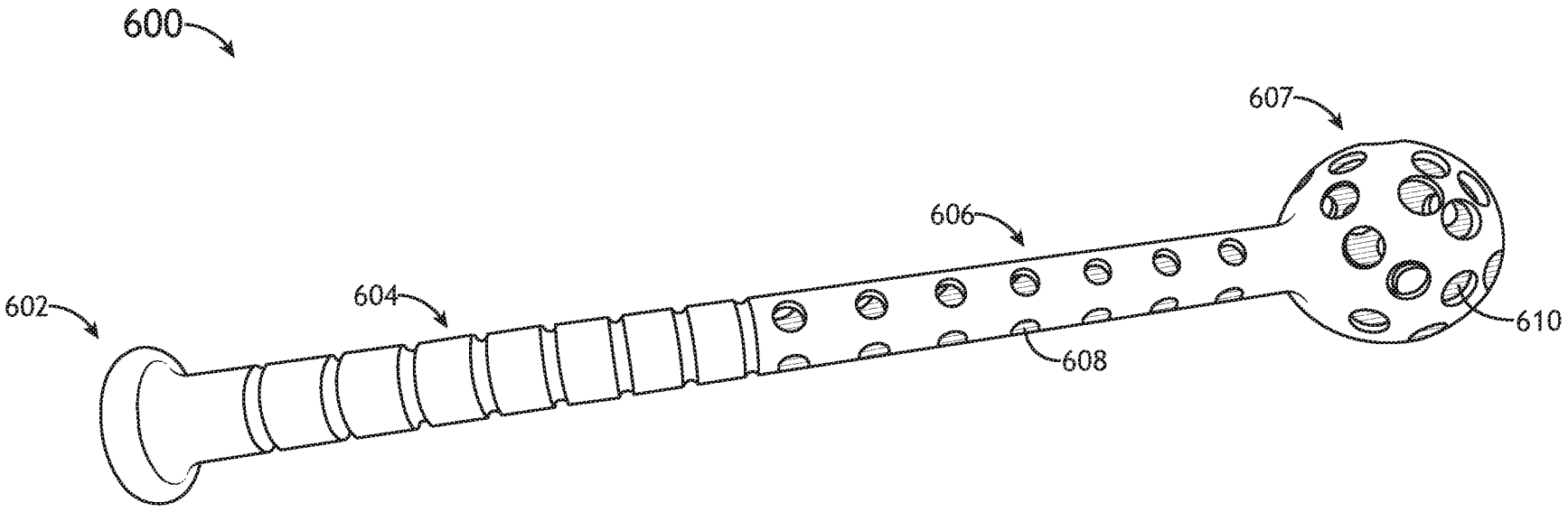
FIG. 6A illustrates an isometric view of a training apparatus, in accordance with one or more alternative embodiments of the present disclosure.
Figure 6B:
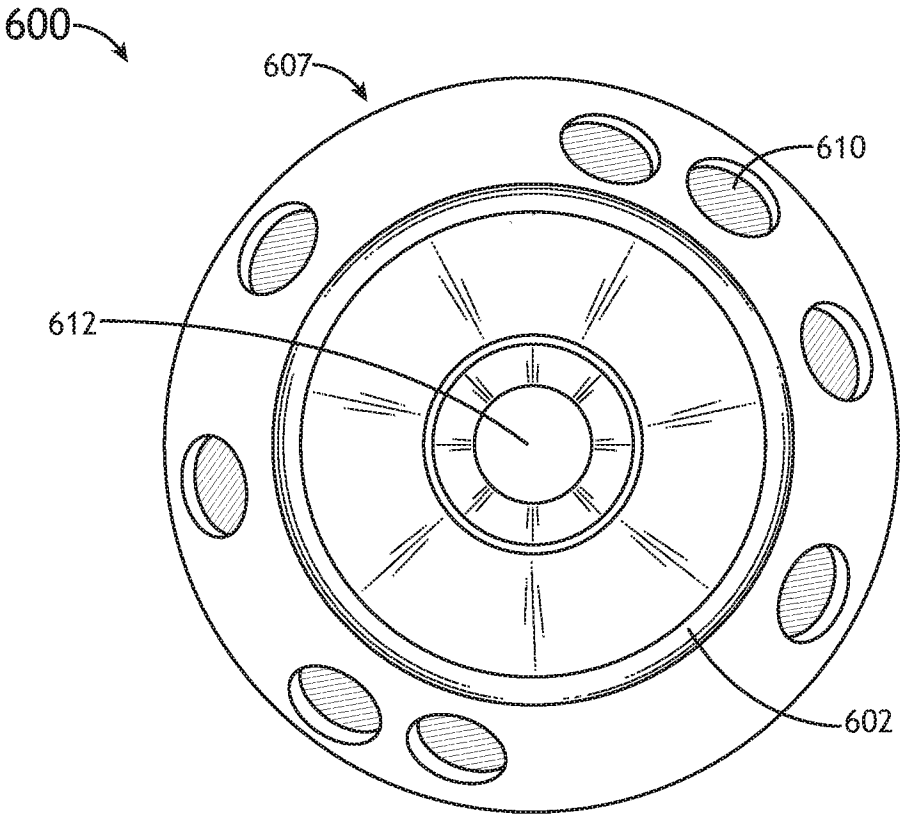
FIG. 6B illustrates a bottom view of a knob of the training apparatus, in accordance with one or more alternative embodiments of the present disclosure.

It is noted herein that while the training apparatus 100 has been illustrated closely resembling a baseball bat, the various embodiments of the present disclosure may be extended to one or more other sporting devices (as shown in FIGS. 6A-6B) such as, but not limited to, sporting devices used in tennis (e.g., tennis racket), softball (e.g., softball bat), lacrosse (e.g., lacrosse stick), cricket (e.g., cricket bat), hockey (e.g., hockey stick), field hockey (e.g., field hockey stick), golf (e.g., golf club), and boxing. It is also noted herein that the training apparatus 100 of the present disclosure may be used to increase muscular strength for healthy adults, elderly adults, individuals in rehabilitation, and individuals of any age.

FIG. 6A illustrates an isometric view of a training apparatus 600, in accordance with one or more alternative embodiments of the present disclosure. FIG. 6B illustrates a bottom view of a knob of the training apparatus 600, in accordance with one or more alternative embodiments of the present disclosure.

In one embodiment, the training apparatus 600 includes a handle 604. In one embodiment, the handle 604 is smooth. In another embodiment, the handle 604 is textured. For example, the handle 604 may have a roughened surface. By way of another example, the handle 604 may have a patterned surface. For instance, the handle 604 may have lines or grooves (e.g., ridges) oriented lengthwise, widthwise, or at a diagonal along at least a portion of the handle 604. It is noted herein that features located on the handle 604 of the apparatus 600 are thought to aid an individual in grasping the apparatus in a steady manner and prevent the apparatus from slipping when being swung in either an upward or downward motion.

In another embodiment, the training apparatus 600 includes knob 602 disposed at an end of the handle 604. In one embodiment, the knob includes a channel 612 for allowing fluid flow through the knob 602 (as shown in FIG. 6B). In another embodiment, the knob 602 is mechanically and fluidically coupled to the handle 604.

In another embodiment, the training apparatus 600 includes a shaft 606. In one embodiment, the shaft 606 includes a plurality of holes 608 disposed across the shaft 606. In another embodiment, each of the holes 608 pass through a wall of the shaft 606.

In another embodiment, the training apparatus 600 includes a head 607. It is noted herein that the head 607 may be the shape of at least one of a golf club head (e.g., driver, wedge, iron, or the like), a sphere, or the like. In another embodiment, the shaft 606 is mechanically and fluidically coupled to the head 607.

In one embodiment, the head 607 includes a plurality of holes 610 disposed across the head 607. In another embodiment, each of the holes 610 pass through a wall of the head 607.

It is noted herein that the shape of the plurality of holes 608, 610 may be any shape (or curved shaped to conform with the curvature of the apparatus 600) known in the art. The circular shape shown in FIG. 6A is provided merely for illustrative purposes. The shape of the holes may include, but is not limited to, curved circles, ellipses, ovals, quadrilaterals, polygons, and the like. Moreover, the shape of the holes 608, 610 may have shapes that significantly depart from the shapes shown in FIG. 6A. For example, the holes 608 and/or the holes 610 may include a set of parallel vents (i.e., long rectangular, ellipse, and/or oval shaped openings) running the length of the shaft 606 or encircling the head 607.

The plurality of holes 608 may pass through the surface of the shaft 606 such that when in operation the water and/or air can flow through the holes 608. The plurality of holes 610 may pass through the surface of the head 607 such that when in operation the water and/or air can flow through the holes 610 and enter the interior of the head 607.

In another embodiment, the knob 602, the handle 604, the shaft 606, and the head 607 are fluidically coupled such that water and/or air may flow through the head 607, the shaft 606, the handle 604, and the knob 602.

It is noted herein that one or more components of the training apparatus 100, 600 may be formed of any material known in the art such as, but not limited to, plastic, wood, fiber glass, metal (e.g., aluminum, titanium, or the like), graphite, or the like.

With respect to the use of substantially any plural and/or singular terms herein, those having skill in the art can translate from the plural to the singular and/or from the singular to the plural as is appropriate to the context and/or application. The various singular/plural permutations are not expressly set forth herein for sake of clarity.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of the subject matter described herein.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to claims containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that typically a disjunctive word and/or phrase presenting two or more alternative terms, whether in the description, claims, or drawings, should be understood to contemplate the possibilities of including one of the terms, either of the terms, or both terms unless context dictates otherwise. For example, the phrase "A or B" will be typically understood to include the possibilities of "A" or "B" or "A and B".

With respect to the appended claims, those skilled in the art will appreciate that recited operations therein may generally be performed in any order. Also, although various operational flows are presented in a sequence(s), it should be understood that the various operations may be performed in other orders than those which are illustrated, or may be performed concurrently. Examples of such alternate orderings may include overlapping, interleaved, interrupted, reordered, incremental, preparatory, supplemental, simultaneous, reverse, or other variant orderings, unless context dictates otherwise. Furthermore, terms like "responsive to," "related to," or other past-tense adjectives are generally not intended to exclude such variants, unless context dictates otherwise.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes. Accordingly, the scope of the invention should be limited only by the claims appended hereto.

What is claimed:

1. An underwater training apparatus comprising:

a barrel, wherein the barrel contains a plurality of holes disposed across the barrel, wherein each of the holes of the barrel pass through a wall of the barrel;

a base funnel, wherein the base funnel contains a plurality of holes disposed across the base funnel, wherein each of the holes of the base funnel pass through a wall of the base funnel, wherein a diameter of the base funnel is larger than an outermost diameter of the barrel to provide resistance to an initial swinging motion; and a handle, wherein the handle mechanically couples the barrel and the base funnel.

2. The training apparatus of claim 1, wherein the barrel, the handle, and the base funnel are fluidically coupled such that water can flow through the barrel, handle, and base funnel.

3. The training apparatus of claim 2, wherein the diameter of the base funnel is between 2.5 and 6 inches.

4. The training apparatus of claim 2, wherein the diameter of the base funnel is approximately 3.5 inches.

5. The training apparatus of claim 1, wherein the barrel and the handle are configured with a shape of at least one of a baseball bat, a softball bat, a cricket bat, a tennis racket, a golf club, or a hockey stick.

6. The training apparatus of claim 1, wherein at least some of the holes in the barrel are shaped as at least one of a circle or an ellipse.

7. The training apparatus of claim 1, wherein at least some of the holes in the barrel are shaped as a polygon.

8. The training apparatus of claim 1, wherein at least some of the holes in the barrel are shaped as vents.

9. The training apparatus of claim 1, wherein at least some of the holes in the base funnel are shaped as at least one of a circle or an ellipse.

10. The training apparatus of claim 1, wherein at least some of the holes in the base funnel are shaped as a polygon.

11. The training apparatus of claim 1, wherein at least some of the holes in the base funnel are shaped as vents.

12. An underwater training apparatus comprising:

a barrel, wherein the barrel contains a plurality of holes disposed across the barrel, wherein each of the holes of the barrel pass through a wall of the barrel, wherein the barrel is shaped as a barrel of at least one of a baseball bat or a softball bat;

a base funnel defined by a wall with an inner surface of increasing diameter exposed to an axial end of the apparatus, wherein the base funnel contains a plurality of holes disposed across the base funnel, wherein each of the holes of the base funnel pass through the wall of the base funnel to provide resistance to an initial swinging motion, wherein the base funnel has a diameter between 2.5 and 6 inches; and a handle, wherein the handle mechanically and fluidically couples the barrel and the base funnel.

13. The training apparatus of claim 12, wherein at least some of the holes in the barrel are shaped as at least one of a circle or an ellipse.

14. The training apparatus of claim 12, wherein at least some of the holes in the barrel are shaped as a polygon.

15. The training apparatus of claim 12, wherein at least some of the holes in the barrel are shaped as vents.

16. The training apparatus of claim 12, wherein at least some of the holes in the base funnel are shaped as at least one of a circle or an ellipse.

17. The training apparatus of claim 12, wherein at least some of the holes in the based funnel are shaped as a polygon.

18. The training apparatus of claim 12, wherein at least some of the holes in the base funnel are shaped as vents.

* * * * *